United States Patent [19]

Kinberg

[11] Patent Number: 4,927,748

[45] Date of Patent: May 22, 1990

[54] LUMINESCENT WRITING OR DISPLAY DEVICE

[76] Inventor: Benjamin Kinberg, 200 Fifth Ave., New York, N.Y. 10010

[21] Appl. No.: 315,611

[22] Filed: Feb. 27, 1989

[51] Int. Cl.[5] ..... B43L 1/12

[52] U.S. Cl. ..... 434/410

[58] Field of Search ..... 434/410

[56] References Cited

U.S. PATENT DOCUMENTS 2,697,884 0/1954 Dechert ..... 434/410

4,011,665 3/1977 Port ..... 434/410

*Primary Examiner*—Edward M. Coven

*Assistant Examiner*—Valerie Szczepanik

*Attorney, Agent, or Firm*—Arthur T. Fattibene

[57] ABSTRACT

A display or writing slate capable of producing luminescent images upon the application of pressure thereon which can be readily erased and repeatedly used that includes a pair of over-lying sheets, one of which is translucent or transparent, containing a luminescent dye or pigment and the other of which is opaque, and which sheets have a smooth surface at their interface. At least one of the sheets is formed of a pliable plastic with its interface surface tending to adhere to the interfacing surface of the other sheet when a pressure is applied thereto to produce the luminescent images. The improvement resides in the incorporation of a non-migrating dye or pigment in the translucent or transparent sheet so as to resist the migration of the luminescent dye or pigment from the translucent or transparent sheet to the interface surface of the other sheet.

5 Claims, 1 Drawing Sheet

LUMINESCENT WRITING OR DISPLAY DEVICE

FIELD OF INVENTION

This invention is directed to an improved writing and display device for producing semi-permanent images or writings thereon that will appear as glowing or luminescent images.

PROBLEM AND PRIOR ART

Writing and display devices of the type disclosed in my prior U.S. Pat. No. 3,761,343 granted Sept. 25, 1973, are now well known and have been extensively applied to many toy type items and other writing or display products. U.S. Pat. No. 4,011,665 has also been granted for a similar type of writing and display device. The subject of both of the foregoing identified patents requires a transluscent or transparent plastic sheet that contains a luminescent dye and a complementary opaque sheet disposed contiguous thereto,so that when a pressure was applied thereto, the two sheets would tend to adhere to one another along the points of applied pressures to produce a glowing or luminescent type image. However, in the prior art devices embodying this principle, it has been observed that there is a tendency of luminescent dye to migrate out of the translucent or transparent sheet and "bleed" onto the adjacent opaque sheet. If permitted, the "bleeding" of the dye from the transparent or transluscent sheet and onto the interfacing surface of the opaque sheet would render the device inoperative or substantially negate the glowing or luminescent effect so as to minimize the operability of the device. To obviate this "bleeding" effect, it was heretofore necessary to place or insert a protective sheet of material or insert between the dye contained transparent or transluscent sheet and the opaque sheet, and which protective sheet or insert had to be removed whenever the device was to be used, and re-inserted between the two sheets when the device was not in use. Thus, the protective sheet or insert resulted in an added cost to the manufacturer and ultimately to the consumer or purchaser. Also, it frequently happened that the user would neglect to reinsert the protective sheet or insert between the transparent sheet and the opaque sheet when the device was not in use or stored. As a result, the dye of the transparent sheet would "bleed" out and in time would render the device inoperative and/or reduce the effectiveness thereof.

OBJECTS

An object of this invention resides in providing a writing or display device for producing a luminescent or glowing image with a transparent or luminescent sheet in which the migration of the luminescent dye or pigment therein is retarded or prohibited.

Another object is to provide a luminescent writing device or slate with a vinyl transparent sheet formulated with a plasticizer in which a luminescent dye or pigment is dispensed that retards the migration of the dye or pigment out of the sheet.

SUMMARY OF THE INVENTION

The foregoing objects and other features and advantages are attained by a luminescent writing device or display which includes a pair of contiguous or superposed sheets of material, one of which comprises a transluscent or transparent plastic sheet, e.g. a vinyl sheet, formulated with a primary plasticizer that resists migration; exudation or volatilization out of the surface of the vinyl sheet under normal or storage conditions and having disbursed therethrough a suitable fluorescent or luminescent dye or pigment. Disposed contiguous to such formulated transluscent or transparent sheet is an opaque sheet. The respective sheets are provided with a smooth surface at the interface thereof so that when a pressure is applied thereto, there is a tendency of the sheets to adhere to one another along the lines of applied pressure causing a glowing or luminescent image to appear along the lines of pressure. The images so formed are readily erased by separating the sheets to break the adhesive or cohesive forces between the sheets. Upon so erasing the glowing image, the writing device is again readied for use.

FEATURES

A feature of this invention resides in the provision of a luminescent writing or display device having a transparent or transluscent sheet impregnated with a fluorescent or luminescent pigment or dye formulated with a low volatile plasticizer that prohibits migration and/or "bleeding" of the luminescent materials out of the sheet.

Another feature of this invention resides in the provision of a luminescent writing or display device in which a separator or insert sheet is not required to be disposed between the transparent sheet and its continuous opaque sheet when the device is not being used and/or in storage so as to prohibit the "bleeding" effect.

Other features and advantages will become more readily apparent when considered in view of the following detailed description.

IN THE DRAWINGS

DETAILED DESCRIPTION

Figure 1:
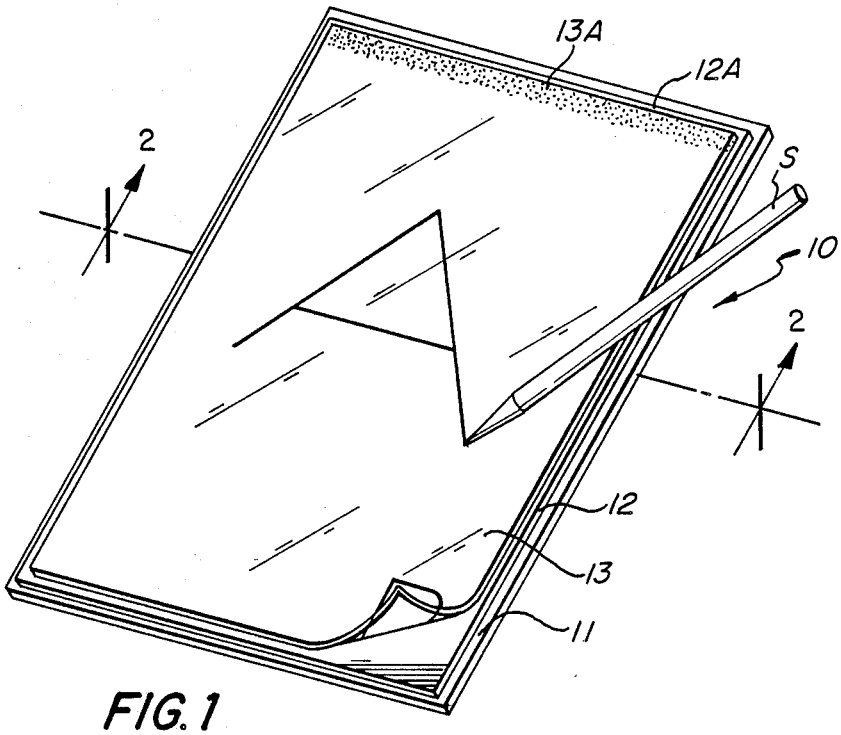
FIG. 1 illustrates a preferred embodiment of the invention.

Referring to the drawings, there is shown a writing and display device 10 embodying the invention. While the writing and display device may take various forms, the simplest and preferred form may be made to resemble a writing tablet, pad or slate comprising a relatively rigid backing member 11, which can be made of any suitable rigid material, e.g. cardboard, non-pliable plastic and the like. Supported on or secured to the backing member 11 and rendered substantially co-extensive thereto is a relatively smooth pliable sheet of a plastic material 12 which is opaque and preferably having a white or "milk color" opacity. The plastic sheet 12 may be formed of a pliable vinyl type plastic having a smooth, wetable type surface appearance.

Disposed continuous to or immediately above the opaque sheet 12 in interfacing relationship thereto is a transparent or transluscent pliable sheet of material 13 which, according to this invention, has dispersed therethrough a luminescent or fluorescent or transluscent tinting material, e.g. a dye or pigment to result in a transparent/tinted sheet. For the purposes of description, it will be understood that luminescent, fluorescent, irridescent, phosphorescent and glowing are considered to be synonomous in describing the nature of the dye or pigment and the effect or appearance of the image or display produced thereby. Essentially, the nature of the dye or pigment dispersed throughout the transparent sheet is such so as to produce a glowing or luminescent image when a pressure is applied thereto, as will be described. The formulation or dispersement of the luminescent dye or pigment through the transparent sheet 13 is such that any tendency of the luminescent dye or pigment to "bleed" or migrate therefrom is prohibited.

Heretofore, the transparent sheets containing luminescent dyes for making the writing and display devices of the type referred to in U.S. Pat. Nos. 3,761,343 and 4,011,665 were made with the transparent sheet formulated with a dioctyle phthalate plasticizer or other more volatile plasticizer such as dibutyl phthalate and/or having excessive amounts of secondary plasticizer such as aromatic hydrocarbons and chloroparaform, wherein the luminiscent dye was dissolved in the plasticizer. As such, vinyl sheets were readily available. They have been used. However, it has been observed from experience that luminescent writing slates or devices utilizing the available transparent vinyl sheets with a luminescent dye dispersed therethrough so formulated that there was a decided tendency for the luminescent dye to "bleed" out of the transparent sheet and onto the underlying opaque sheet. In a relatively short period of time, the underlying opaque sheet, which was preferably white, would absorb the dye "bleeding" out of the luminescent transparent sheet, causing the opaque white sheet to assume the color of the dye initially dispersed throughout the transparent sheet. When this occurred, the brilliance or "glowing" effect of the images would be greatly diminished to a point where the device was no longer interesting or amusing. To obviate this difficulty, an inert or protective sheet was disposed between the transparent sheet and the opaque sheet to prevent the bleeding and/or absorbtion of the dye onto the opaque sheet when the device was not in use. Such inert or protective sheet was made of any material that would not absorb the dye, e.g. plain paper or non-absorbant cardboard.

To obviate the bleeding effect of the dye from the transparent sheet, the transparent sheet should be formulated with a primary plasticizer that has less migration and/or volatilization than that of dioctyl phthalate, that is conventionally used. The preferred plasticizers for formulating a transparent vinyl sheet for application in accordance with this invention would be one that will substantially resist or retard migration to and exudation or volatilization out of the surface of the vinyl sheet under normal or storage conditions. Such preferred plasticizers for formulating the luminescent transparent sheet 13 may include disodecyl phthalate, trialkyl trimellitates, e.g., trioctyl trimellitate; epoxidized soya oil or other opoxidized fatty esters; polymeric plasticizers such as adipic acid or azelaic acid polyesters of molecular weight 850–6000 made from dicarboxylic acids such as adipic or azelaic acid, e.g. the Paraplex plasticizers made by C.P. Hall Co. of Chicago, Ill.

It has been discovered that the utilization of transparent sheets having a luminescent dye or pigment dispensed therethrough that has been formulated with a primary plasticizer which is less volatile than dioclyl phthalate, that the bleeding of the luminescent dye therefrom is prohibited or substantially retarded so as to substantially improve and enhance the use and application of the luminescent or fluorescent writing or display device herein described. Bleeding can be further minimized or retarded by dispersing fluorescent pigments rather than dyes throughout the transparent sheet 13. While pigments, in contrast to dyes, are solid particles, they are so finely divided that they can be readily dispersed to form transparent colored or tinted plastic film or sheet that is extremely suitable for application as a luminescent or fluorescent writing and display device as herein described.

Figure 3:
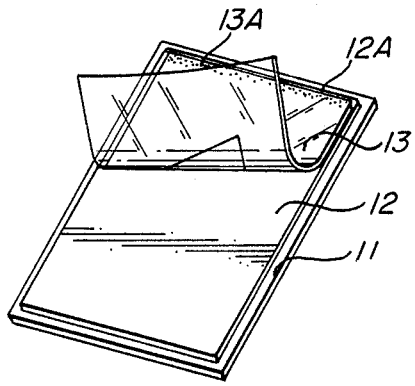
FIG. 3 is a view similar to FIG. 1 illustrating how the formed image may be readily erased.

Referring to FIGS. 1 and 3, it will be noted that the transparent sheet 13 may be suitably secured in overlying position relative to the opaque sheet 12 along one edges thereof, e.g., along edge 13A by suitable means to define a hinging connection between the sheets 12 and 13. This may be effected by adhesively securing the edge portion 13A of sheet 13 to the contiguous edge 12A of sheet 12 by an adhesive, or by a binding hinge strip of material, tacking or other suitable well known hinging construction. As shown in FIG. 3, the hinging effect renders the sheets 12 and 13 readily separable by lifting one from another to effect the erasure of any image formed thereon.

With the construction herein described, the need of positioning a protective sheet or insert between the opaque sheet 12 and the overlying luminescent sheet 13, having a luminescent dye or pigment dispensed therethrough is not required when in storage or not in use.

Figure 2:
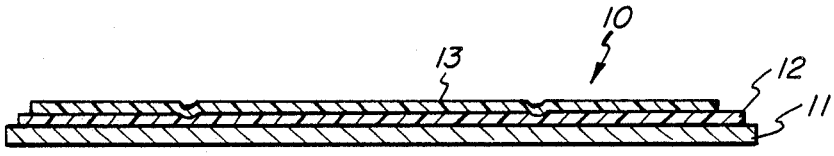
FIG. 2 is a cross-sectional view taken along line 2—2 on FIG. 1.

In operation, it will be understood that whenever a pressure is applied onto one of the sheets, e.g. by a stylus S, the applied pressure thereon will cause the two sheets 12 & 13 to adhere or be urged into intimate contact together at the points of applied pressure (see FIG. 2) so that light reflecting thereat will create an image that appears to be "glowing" or luminescent in appearance. As the interfacing surfaces of sheets 12 and 13 have a smooth, wet-like appearance, they will tend to remain adhered or cohered to one another along the points of applied pressure, to sustain the "glowing" or luminescent image thereat until such time that the cohesive bonding or intimate contact of the two sheets 12 and 13 is broken. This can be readily attained by lifting one sheet away from the other to erase the image. It will be understood that the image may be erased by any suitable separating means disposed between the respective sheets 12 and 13 that will effectively separate the sheets 12 and 13 along the points of applied pressure.

While the invention has been described with respect to a particular embodiment thereof, it will be understood that variations and modifications may be made without departing from the spirit or scope of the invention.

What is claimed is:

1. An improved writing and display device for producing a luminescent image upon the application of a pressure thereon comprising a transparent plastic sheet having means comprising a primary low volatile plasticizer, and containing a luminescent tinting material integrally dispersed throughout said plastic sheet, an opaque white sheet disposed contiguous to said transparent sheet to be in direct interfacing relationship therewith, said transparent sheet and tinting materials therein being in overlying relationship and in direct contacting relationship to said opaque sheet, and said sheets each having an exposed smooth surface for direct contact at the inteface thereof, said means being capable of prohibiting the migration of said tinting material from said transparent sheet and onto said underlying opaque sheet in direct contact therewith, and at least one of said sheets being pliable so that upon the application of pressure thereon, the respective smooth surfaces of said sheets are urged into intimate contact at the points of the applied pressure to form a luminescent image along the points of applied pressure that will be retained so long as said sheets are adhered to one another along the points of applied pressure, whereby any protective insert between said transparent and opaque sheet during non-use of said display device is rendered unnecessary.

2. An improved writing and display device as defined in claim 1 and including a rigid backing member for said opaque sheet, means for securing said transparent sheet relative to said opaque sheet along one edge thereof, wheeby said transparent sheet is disposed in free contiguous overlying relationship with said opaque sheet will not bleed thereon.

3. An improved writing and display device as defined in claim 1 wherein said tinting material comprises a luminescent pigment.

4. An improved writing and display device as defined in claim 2 wherein said transparent sheet is substantially co-extensive in size to said opaque sheet, and said transparent sheet being readily separable from said opaque sheet for effecting the erasure of any luminescent image formed thereon.

5. An improved writing and display device for producing a luminescent semi-permanent image upon the application of pressure thereon comprising a rigid backing member, an opaque plastic sheet secured to said backing member, said opaque plastic sheet having a white smooth surface on at least one side thereof, a transparent plastic sheet disposed contiguous to said opaque sheet, said transparent sheet having a smooth surface disposed into direct contiguous interfacing relationship with said white surface of said opaque sheet, and said transparent sheet being formed as a vinyl plastic sheet having means comprising a primary low volatile plasticizer tinted with a luminescent material integrally dispersed throughout said transparent sheet, said means being capable of prohibiting the migration of said dispersed luminescent material out of said transparent vinyl plastic sheet, said transparent sheet and opaque sheet being substantially co-extensive in size, means for hingedly securing said sheets whereby one of said sheets can be readily separated from the other to effect the erasure of any image formed thereon, at least one of said sheets being pliable so that upon the application of pressure thereon, the direct interfacing surfaces of said sheets are urged into intimate contact to co-adhere to one another at the points of applied pressure to form a luminescent image in accordance with the points of applied pressure whereby said image is retained until said sheets are separated along said points of applied pressure, and said transparent sheet and tinting material dispersed therein being capable of being in direct contact with said opaque sheet without having the luminescent material dispersed therethrough migrating out of said transparent sheet and onto said opaque sheet in contact therewith, whereby any protective insert between said transparent sheet and opaque sheet during non-use of said display device is rendered unnecessary.

* * * * *